US011864612B2

(12) United States Patent
Ferguson

(10) Patent No.: US 11,864,612 B2
(45) Date of Patent: Jan. 9, 2024

(54) HEADBAND HAVING SUSPENDED COMFORT ELEMENT

(71) Applicant: RIVERPOINT MEDICAL, LLC, Portland, OR (US)

(72) Inventor: John Thomas Ferguson, Portland, OR (US)

(73) Assignee: Riverpoint Medical, LLC, Portland, OR (US)

( * ) Notice: Subject to any disclaimer, the term of this patent is extended or adjusted under 35 U.S.C. 154(b) by 785 days.

(21) Appl. No.: 16/922,781

(22) Filed: Jul. 7, 2020

(65) Prior Publication Data

US 2020/0405001 A1 Dec. 31, 2020

Related U.S. Application Data

(63) Continuation-in-part of application No. 16/255,277, filed on Jan. 23, 2019, now Pat. No. 11,147,648.

(51) Int. Cl.
*A42B 3/14* (2006.01)

(52) U.S. Cl.
CPC ..... *A42B 3/145* (2013.01); *Y10S 2/11* (2013.01)

(58) Field of Classification Search
CPC .. A42B 3/145; A42B 3/14; A42B 3/00; A42B 3/04; A42B 1/242; Y10S 2/11; F21V 33/00; F21V 33/0064; F21V 21/084; F21V 33/0068; F21V 15/00; A61B 1/06; A61B 19/5202; A61B 19/262; A61B 2019/521; A61B 2019/084; A61B 2019/262; F21Y 2101/00
See application file for complete search history.

(56) References Cited

U.S. PATENT DOCUMENTS

| | | | | |
|---|---|---|---|---|
| 5,412,811 | A * | 5/1995 | Hildenbrand | A61B 90/50 2/418 |
| 8,348,448 | B2 | 1/2013 | Orozco et al. | |
| 11,147,648 | B2 * | 10/2021 | Ferguson | F21V 21/084 |
| 2020/0003400 | A1 * | 1/2020 | Kelly | A42B 1/242 |
| 2020/0109847 | A1 | 4/2020 | Poggio | |
| 2020/0229891 | A1 | 7/2020 | Ferguson | |

* cited by examiner

*Primary Examiner* — Bao Q Truong
(74) *Attorney, Agent, or Firm* — BrainSpark Associates, LLC

(57) ABSTRACT

A headband assembly, having a preferred orientation relative to a wearer's head, and including a closed form headband adapted to encircle a human head horizontally, thereby defining an inner surface and wherein at least one hard portion of the headband is hard relative to another portion of the headband. Also, a resiliently deformable wingset is supported by the headstrap subassembly on the inner surface, about the hard portion and includes a central part and two wings, each wing extending laterally outwardly from the central part, each wing extending forward as it extends laterally from the central part and having a wing end. A wingset holder, engaged to both the wing ends, so that at least a portion of the holder is suspended between the wing ends, thereby holding a wearer's head away from the hard portion when in use.

20 Claims, 9 Drawing Sheets

HEADBAND HAVING SUSPENDED COMFORT ELEMENT

RELATED APPLICATIONS

This application is a continuation-in-part of application U.S. Ser. No. 16/255,277, filed on Jan. 23, 2019, which is incorporated by reference as if fully set forth herein.

BACKGROUND OF THE INVENTION

An item that is worn, even if comfortable at first, can become painfully uncomfortable after a few hours. This is certainly the case with the headband for a medical headlamp assembly. In order to keep the headlamp rigidly in place, the headband must have some rigidity and must be fastened firmly to the head. But this means that any incongruity between the strap, which is essentially flat, and the sides of the head of the wearer, which are not flat, will become increasingly painful over time. Although many headstrap configurations have been used over the years, none appear to have been fully embraced by the community of surgeons using them. Some further innovation is desirable.

One device intended to ease the sensation of wearing a medical headlamp for a long period of time is described in U.S. Pat. No. 8,348,448. The "stabilizer" described in this patent, however, may prove a burden to some wearers, due to its size. In particular, wearers with long hair, in particular, if it is arranged in a pony-tail, may be faced with a difficulty in threading their hair through the headband, as it may be blocked by the stabilizer.

SUMMARY OF INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a headband assembly, having a preferred orientation relative to a wearer's head, and including a closed form headband adapted to encircle a human head horizontally, thereby defining an inner surface and wherein at least one hard portion of the headband is hard relative to another portion of the headband. Also, a resiliently deformable wingset is supported by the headstrap subassembly on the inner surface, about the hard portion and includes a central part and two wings, each wing extending laterally outwardly from the central part, each wing extending forward as it extends laterally from the central part and having a wing end. A wingset holder, engaged to both the wing ends, so that at least a portion of the holder is suspended between the wing ends, thereby holding a wearer's head away from the hard portion when in use.

In a second separate aspect, the present invention may take the form of a comfort assembly, having a front adapted to receive a portion of a human head, and including a resiliently deformable wingset having a back and a front, and including a central part and two wings, each extending laterally outwardly from the central part, each wing extending forward as it extends laterally from the central part and having a wing end. Also, a wingset holder includes a sheet of flexible material and has pockets for receiving the wing ends, and wherein when the pockets are engaged to the wing ends at least a portion of the sheet is suspended between the wing ends, and forms the front of the comfort assembly. The holder further has a first edge having a first fastener and a second edge having a second fastener that can be fastened to the first fastener, when the first and second edges are wrapped about the wingset to the back of the wingset.

In a third separate aspect, the present invention may take the form of a method of augmenting a headband assembly, having a preferred orientation relative to a wearer's head, and which includes a closed form headband adapted to encircle a human head horizontally, thereby defining an inner surface and an outer side and at least one hard portion of the headband and being hard relative to another portion of the headband. The method utilizes a comfort assembly that has a resiliently deformable wingset, including a central part and two wings, each extending laterally outwardly from the central part, each wing extending forward as it extends laterally from the central part and having a wing end. Also, a wingset holder, includes a sheet of flexible material, and is engaged to both the wing ends, so that at least a portion of the sheet is suspended between the wing ends, the holder further having a first edge having a first fastener and a second edge having a second fastener. In the method, the comfort assembly is attached to the head band assembly at the hard portion by placing the wingset on the inner surface of the hard portion and wrapping the edges about to the outer side of the hard portion and fastening the first fastener to the second fastener.

BRIEF DESCRIPTION OF DRAWINGS

Various embodiments of the invention are disclosed in the following detailed description and accompanying drawings.

DETAILED DESCRIPTION AND EMBODIMENTS

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

To assist the description of the scope and its components the coordinate terms front and back are used to describe the disclosed embodiments. The terms are used consistently with the description of the exemplary applications and are in reference to the head of a user. In other words, the front of any device or part is in front when worn in a preferred orientation on a user's head.

1. Definitions

The term "strap" as used in this application may refer to two straps joined together by an adjustable joining element, such as a buckle.

2. Description

Figure 1:
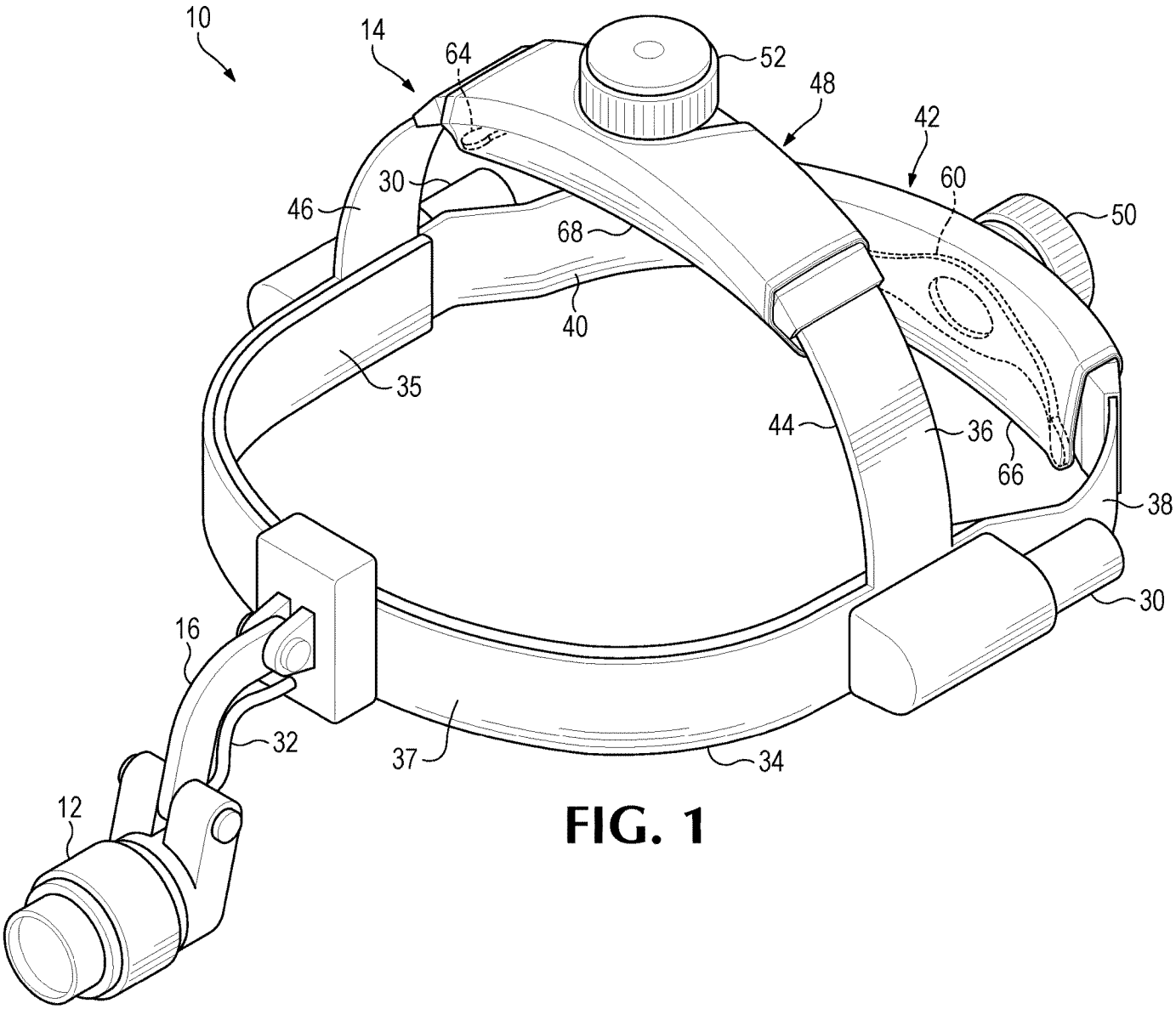
FIG. 1 is an isometric view of a headlamp assembly, according to the present invention.
Figure 2:
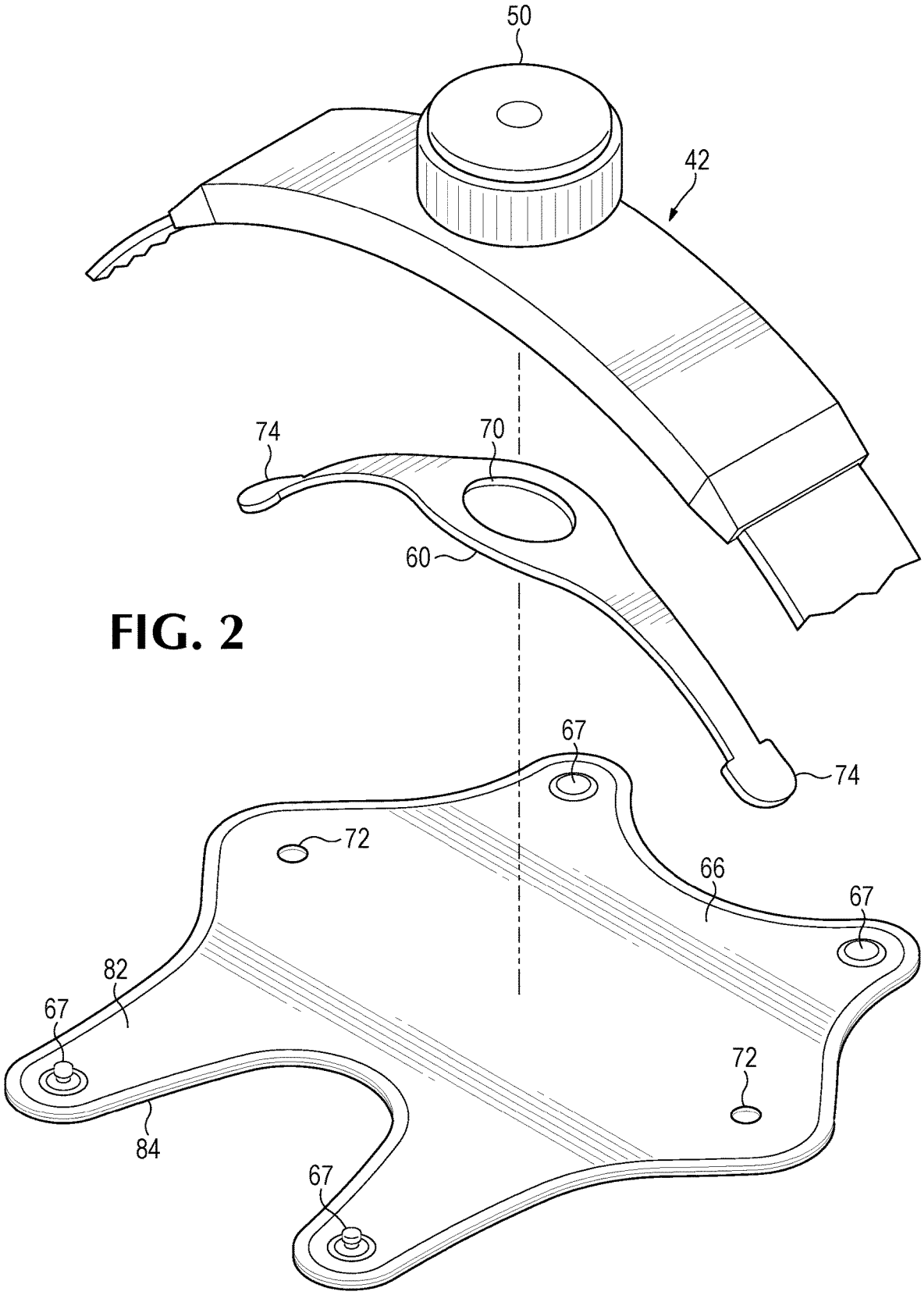
FIG. 2 is an isometric view showing the back wing set attachment of the headlamp assembly of FIG. 1, in a disassembled state (and rotated 90°, to vertical).
Figure 2A:
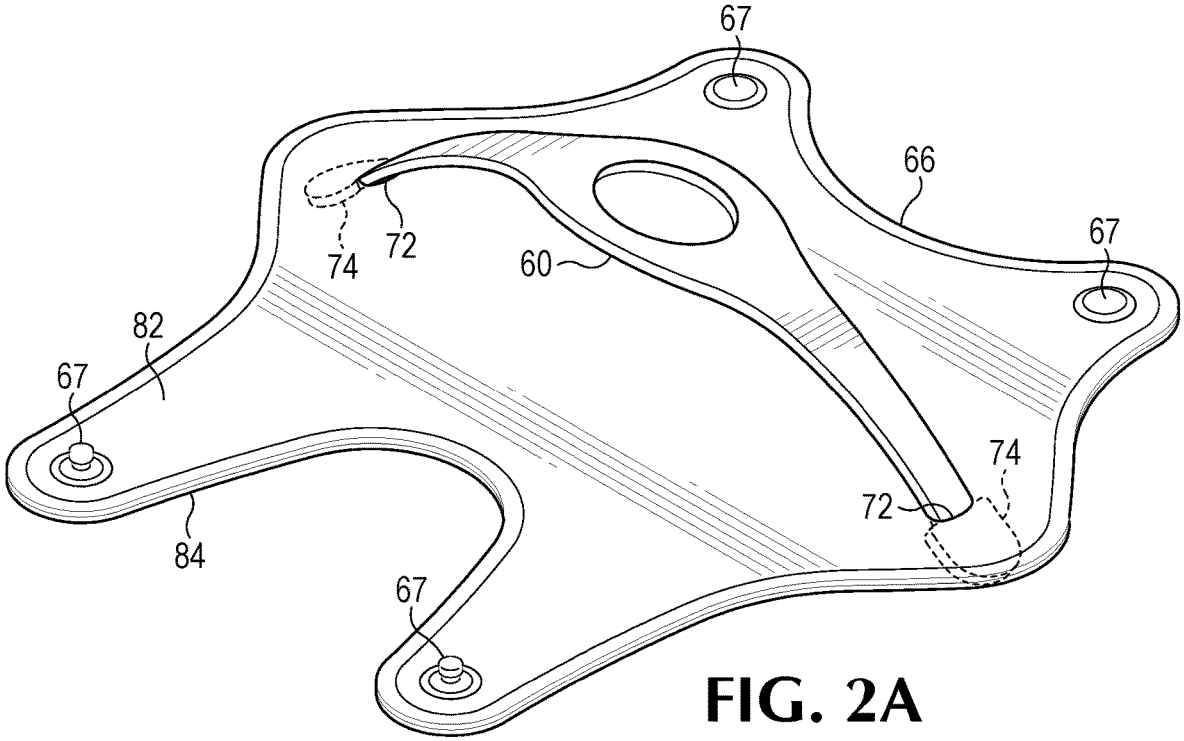
FIG. 2A is an isometric view showing the back wingset and wingset holder of the headlamp assembly of FIG. 1, with the wingset engaged to the wingset holder.
Figure 3:
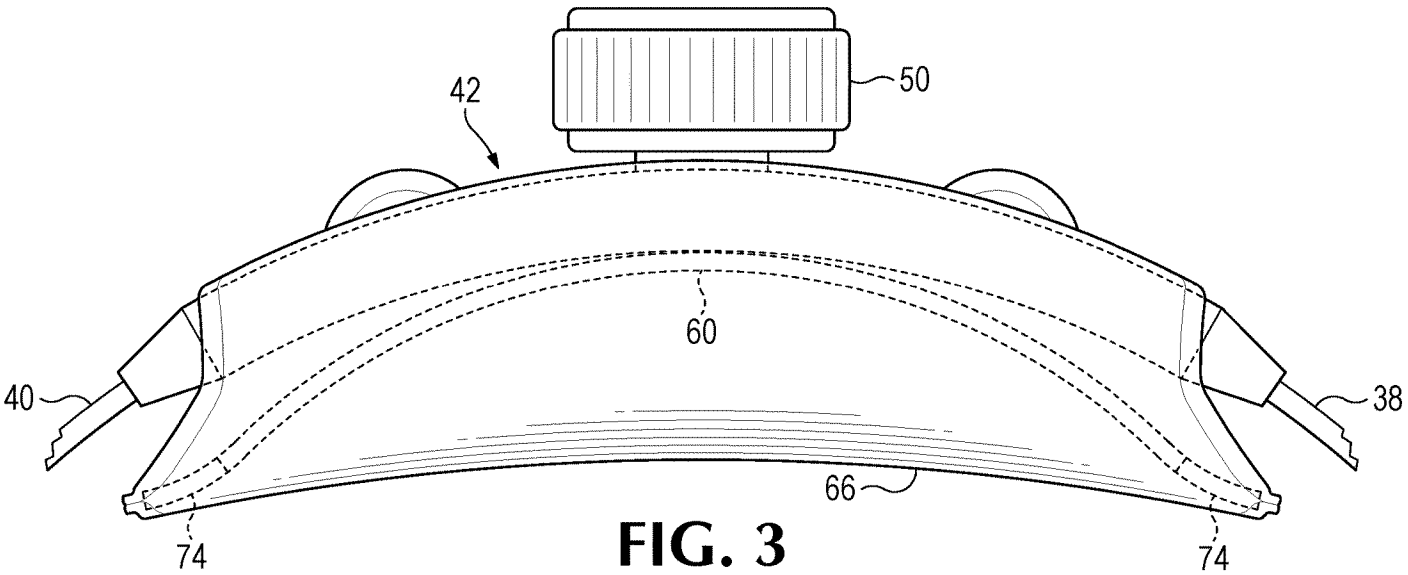
FIG. 3 is a top view of a wingset attachment of FIG. 2, in an assembled state about a tightening adjustment mechanism of the headlamp of FIG. 1.
Figure 4:
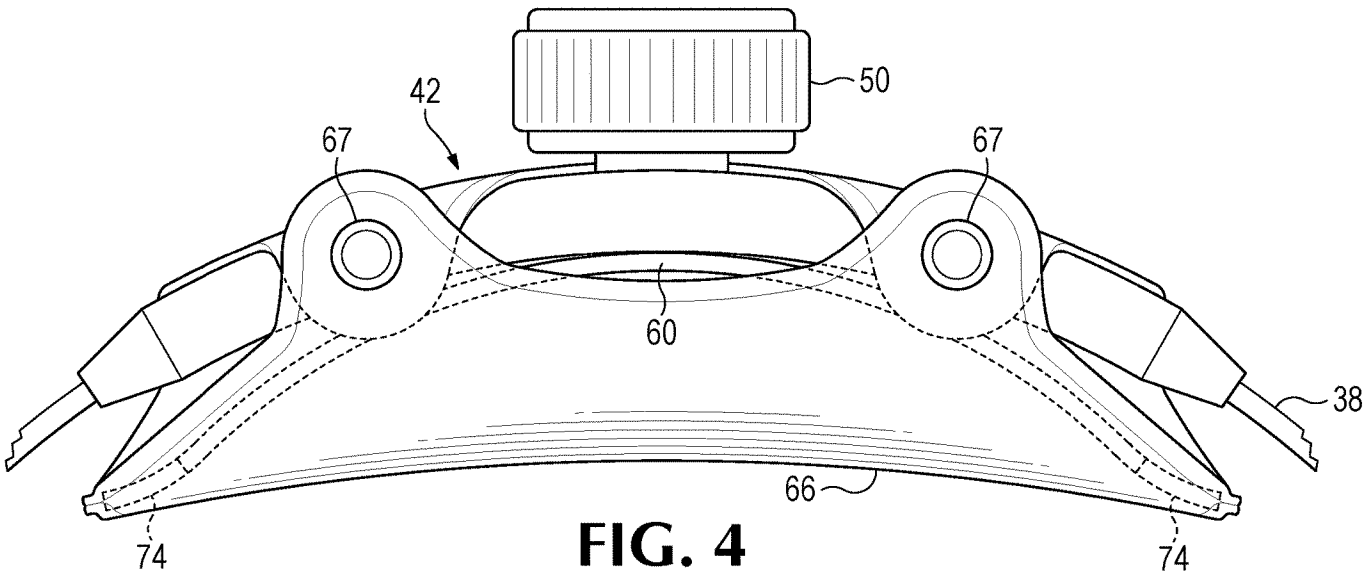
FIG. 4 is a bottom view of a wingset attachment of FIG. 2, in an assembled state about a tightening adjustment mechanism of the headlamp of FIG. 1.
Figure 5:
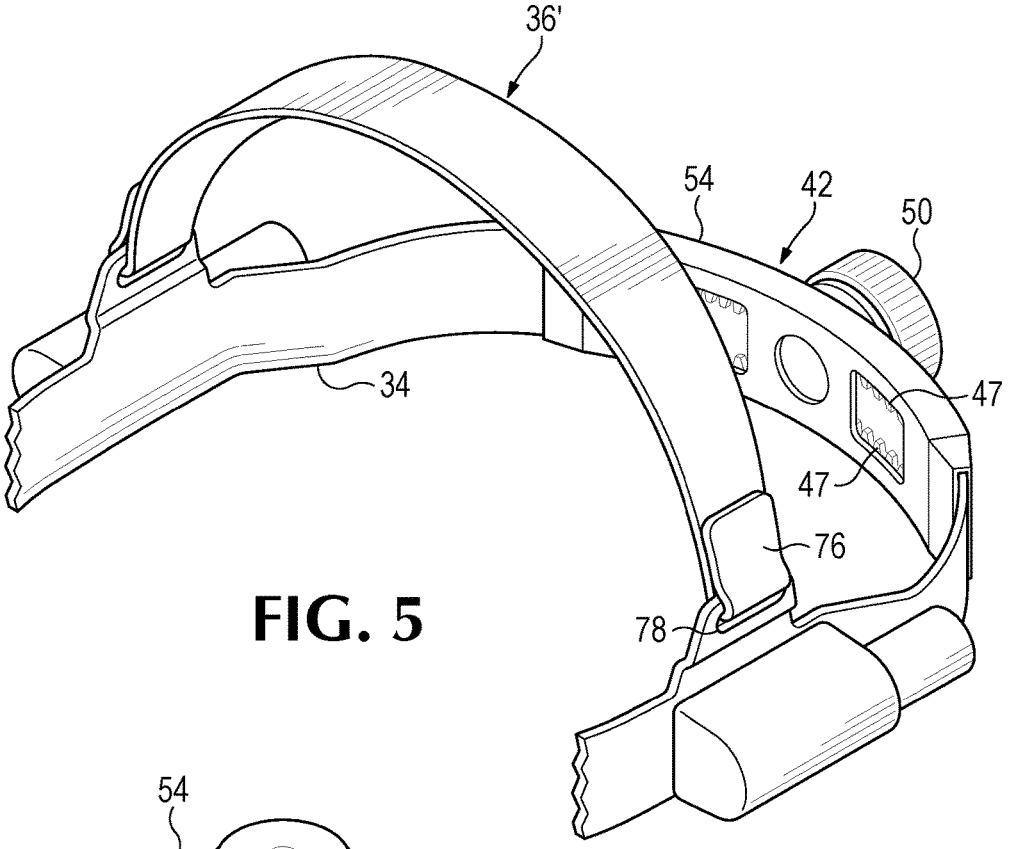
FIG. 5 is a partial perspective view of an alternative embodiment of the headlamp assembly of FIG. 1, showing a soft top strap placed into use.
Figure 6:
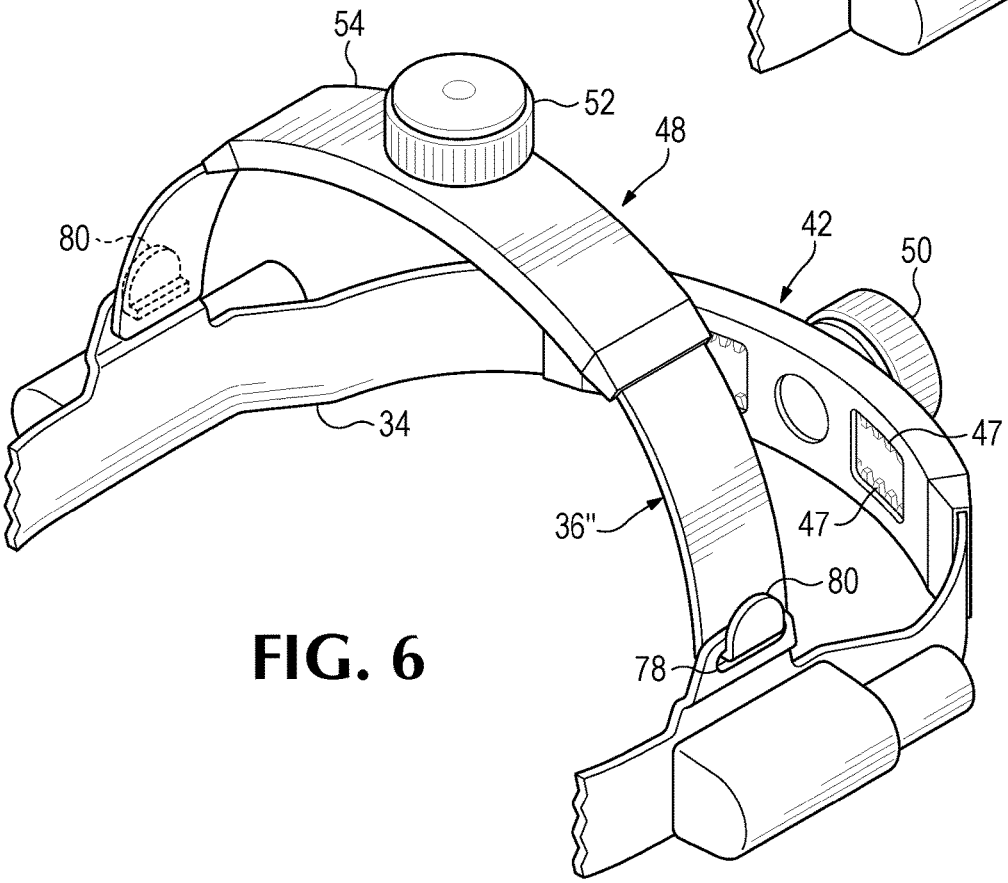
FIG. 6 is a partial perspective view of the alternative embodiment of FIG. 5, showing a tightness adjustable top strap placed into use.
Figure 7:
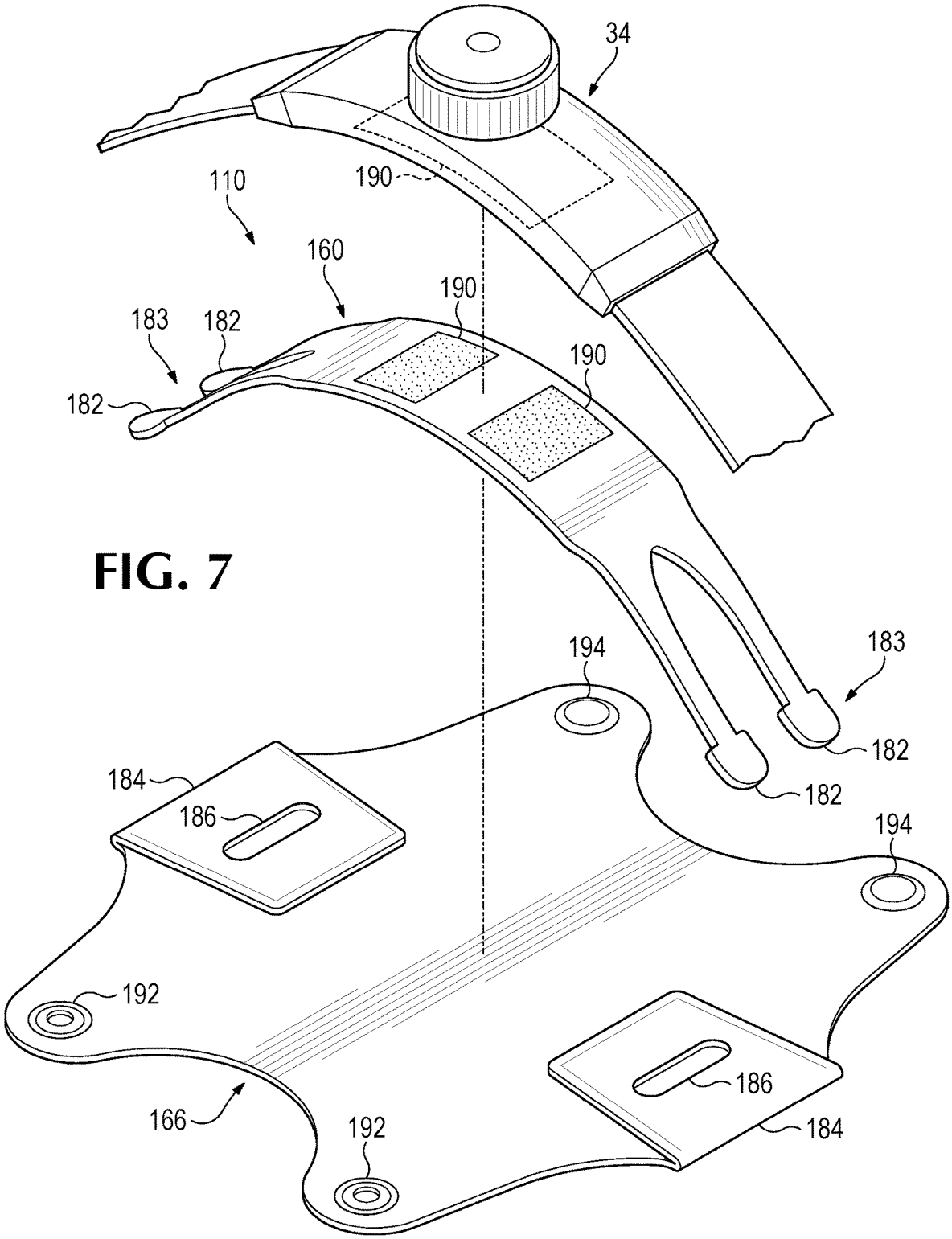
FIG. 7 is an isometric view of a wingset, wingset holder and a portion of a headband, according to an alternative embodiment of the present invention.

Referring to FIG. 1, in a preferred embodiment, a medical headlamp assembly 10 includes a headlamp (also known as a bezel) 12, a headband assembly 14, and a linkage 16, supporting the headlamp 12 from the headband assembly 14. Batteries 30 supply electric power to headlamp 12, typically through an electrical network (not shown) housed in headband assembly 14, and a final wire 32 or other, similar, electrical conductor. Headband assembly 14 is made of a headband 34 and a top band 36. Headband 34 has an inner surface 35, which faces the head when assembly 10 is worn and an opposed outer surface 37. Headband 34 is made up of two straps 38 and 40 that are joined together by tightening mechanism 42. Similarly, the top band 36 is made up of two straps 44 and 46 that are joined together by tightening mechanism 48. Referring to FIGS. 5 and 6, both strap 38 and strap 40 have a an opening with teeth 47 on the top (for a first one of strap 38 and 40), or on the bottom (for a second one of strap 38 or 40), so that a cog wheel (not shown) affixed to a knob 50, will pull straps 38 and 40 to greater overlap with each other when turned in a first direction, and to less overlap with each other when turned in a second direction, opposite to the first direction. An identical mechanism works for a knob 52 and straps 44 and 46 of top band 36. This mechanism represents a great convenience to a surgeon preparing for a surgery, but the need for teeth 47 means that harder polymer materials must be used for straps 38, 40, 44 and 46 than would otherwise be needed. Also, the use of cog wheels (not shown) and guide/holders 54 to keep teeth 47 aligned, make tightening mechanisms 42 and 48 harder than other parts of straps 34 and 36, thereby each constituting a hard portion relative to other portions of assembly 14, which are softer, and resulting in discomfort for extended wear.

Wingsets 60 and 64 are made of a soft, resiliently deformable material such as nylon, polyester a thin strip of resiliently deformable metal, or some combination of these materials. Mechanisms 42 and 48, and the surfaces of the human head do not perfectly conform. Accordingly, it is more comfortable if mechanisms 42 and 48 are kept suspended away from the surfaces of the head, as is done by the two wings of both wingset 60 and 64. The ears 74 of wingsets 60 and 64 gently contact the head (through a layer of fabric, as explained below), avoiding the irritating pressure of a harder contact. Each wingset 60 and 64, includes a central hole 70, which in one embodiment connects about a matching protrusion in the inner surface of mechanisms 42 and 48.

Wingset 60 is held in place by rear wingset holder 66, which snaps together with snap fasteners 67 wrapped about wingset 60 and mechanism 42. In like manner top wingset 64 is held in place by a top wingset holder 68. In one embodiment, holders 66 and 68 are made of quilted material. In another embodiment, they are made of polypropylene or neoprene. For both holders 66 and 68, side holes 72, receive ears 74 of wingset 60 and 64, respectively. This results in ears 74 being cushioned against the side/back of a user's head by a layer of material and of positively retaining ears 74 and thereby, wingsets 60 and 64, with a holder 66 and 68.

Referring to FIGS. 5 and 6, in another aspect of a preferred embodiment a pair of alternative top bands, 36' and 36" are provided. Referring to FIG. 5, top band 36' is soft and elastic, making it more comfortable for many users, and is attachable by way of hook and loop material (not shown), that permits band 36' to form a loop through a slot 78 defined in headband 34. Referring specifically to FIG. 6, top band 36" is the same as band 36, except for that it can be disengaged from headband 34, by removing hooks 80 from slots 78. As some users prefer top band 36' and others prefer top band 36" distribution can be eased by providing each purchaser with both, but they must be made interchangeable, to be able to do this. In an alternative preferred embodiment, a top band similar to 36" is provided, but wherein instead of hooks 80, the top band attaches to itself, forming a loop for engagement to headband 34, by means of mating hook and loop material.

The disclosed embodiments may be used to illuminate a field of view of a surgeon. The surgeon may place assembly 10 on his head, with the headlamp 12 projecting forward from the center of his or her forehead. Tightness adjustments may be made using knobs 50 and 52. But tightness adjustment mechanisms 42 and 48 are lifted away from the surgeon's head by wingsets 60 and 64, respectively. Accordingly, as headlamp 12 illuminates the surgeon's field of view, the surgeon may be more comfortable in assembly 10, than he could otherwise be.

Figure 8:
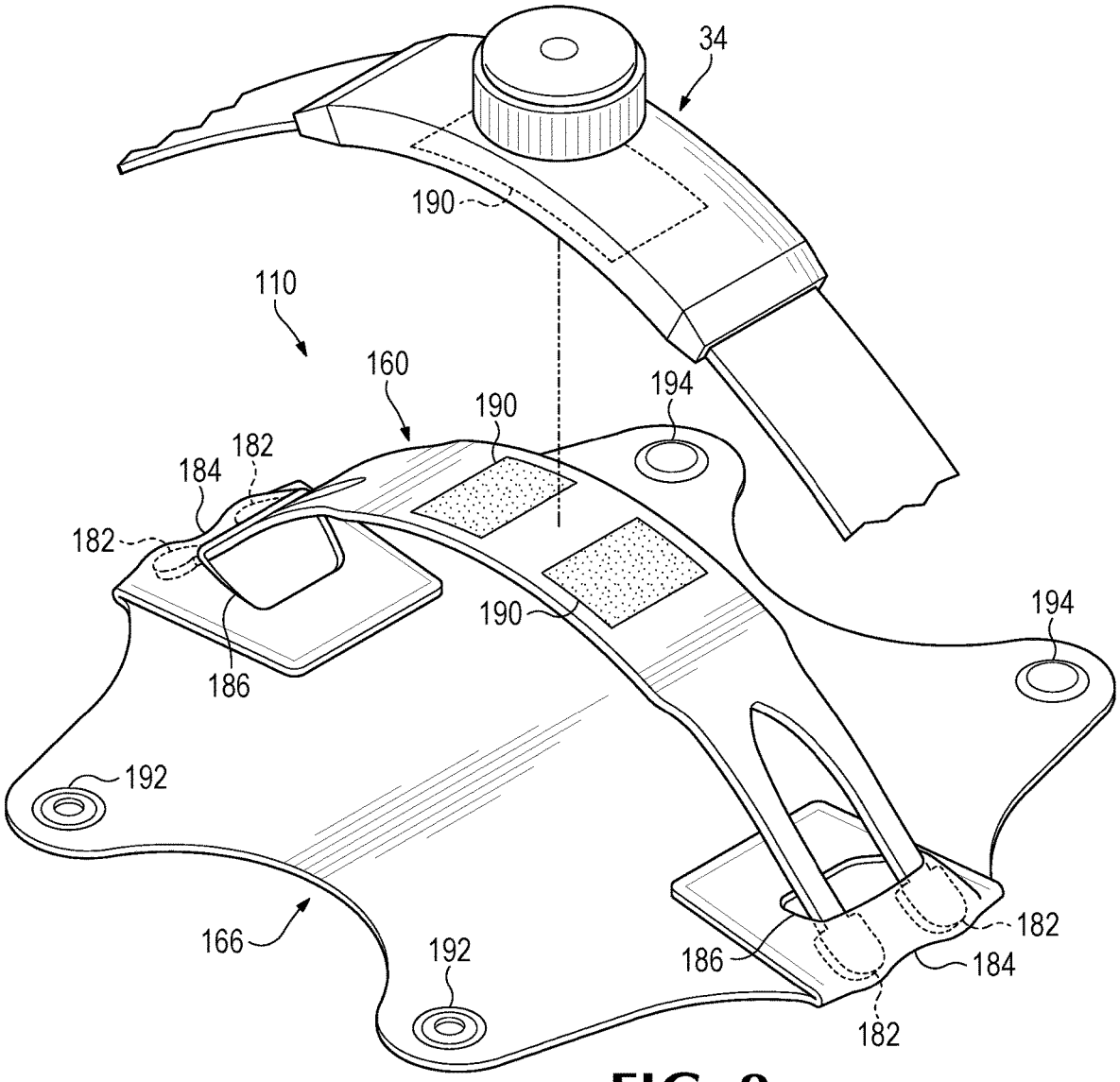
FIG. 8 is an isometric view of a further step of the arrangement of FIG. 7, shown with wingset prongs inserted into the wingset holder.
Figure 9:
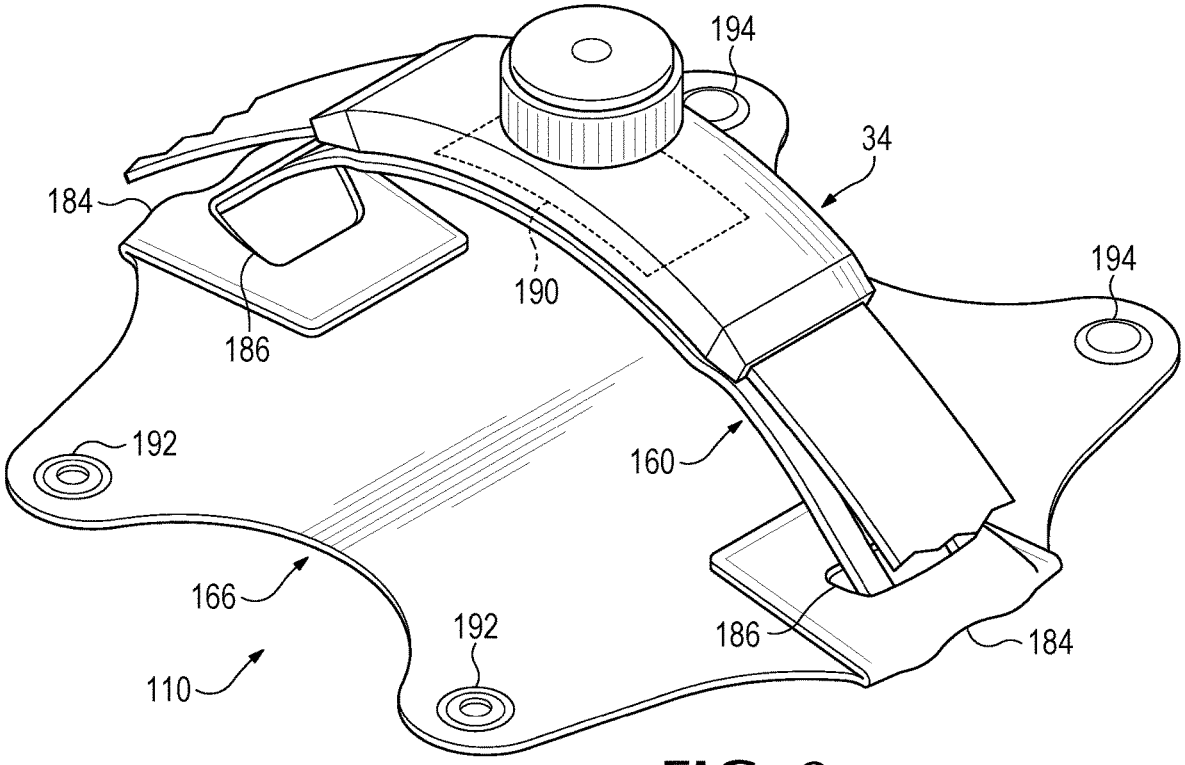
FIG. 9 is an isometric view of a further step from the arrangement of FIG. 8, shown with the wingset now attached to the headband.
Figure 10:
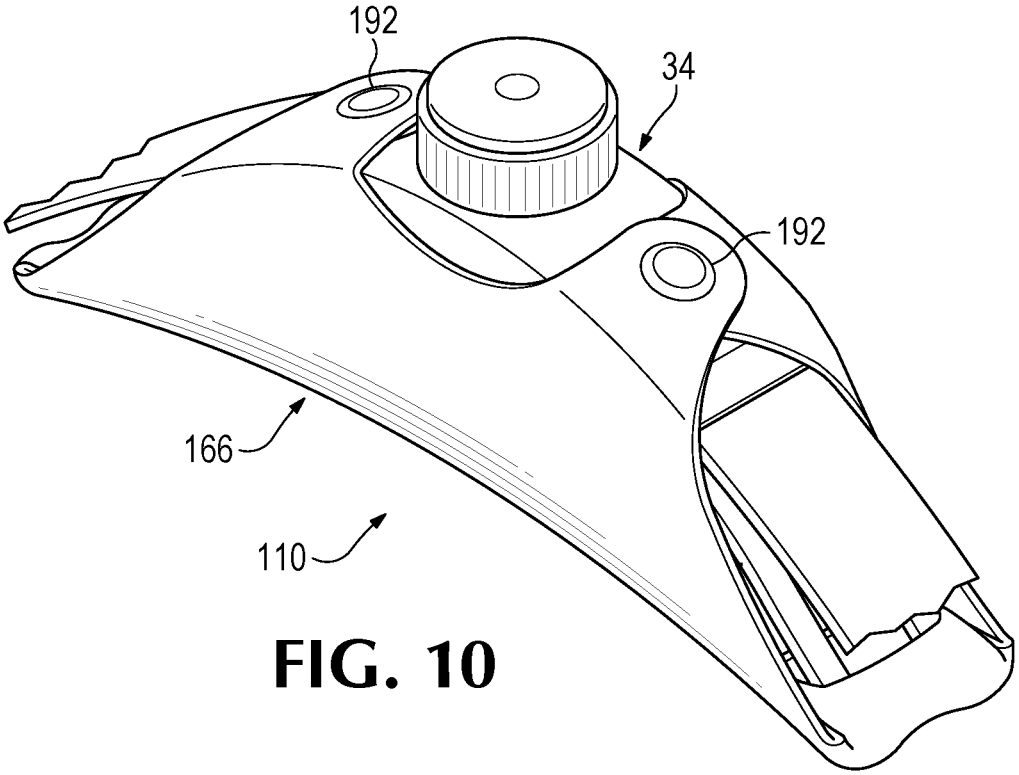
FIG. 10 is an isometric view of a further step from the arrangement of FIG. 9, shown with the wingset holder wrapped about and snapped together about the wingset and headband.

Referring now to FIGS. 7-10, in an alternative embodiment of a comfort assembly 110, a wingset 160 includes two prongs 182 on either side. Each pair of prongs 182, collectively forms a wing end 183. Also, both sides of the wingset holder 166 include a prong harness 184 having a prong slot 186 wide enough to accommodate both prongs 182 also referred to as wing end 183, as shown in FIG. 8. Finally patches of hook and loop material 190 on the wingset 160 and the headband 34 permit a user to attach the wingset 160 to the headband 34 and retain it there, as shown in FIG. 9. This facilitates the next step of wrapping the wingset holder 166 about the wingset and headband 34 and connecting snaps 192, on a first edge, to snaps 194, on a second edge, with the final result as shown in FIG. 10. Hook and loop material 190 must be matingly deployed, so that if it is hook material in the headband 34, there is loop material on the wingset 160, and vice versa.

The effect is that a sort of a hammock is created for the back or top of the head, or both (as headband 34 here is used generally and could just as well be top band 36). The wingset holder 166 yields to the pressure of the head, as do the prongs 182, as wingset is made of a resiliently deformable material, typically a polymer. The tightness adjustment mechanism 42 is kept away from the user's head, avoiding the hardness of this element and the resultant distraction to the user.

Wingset 160 is generally made of a resiliently deformable polymeric material and is between 140 mm and 150 mm in length, in a straight line from the tip of one wing end 183 to the tip of the other wing end 183, when unconstrained. In a preferred embodiment, wingset 160 is between 144 mm and 146 mm in length. Whatever this length, the ends of the prong harnesses (that is the length of wingset 160 when it is set into holder 166 is between 5% and 15% less, so that wingset is 160 is contracted slightly when wing ends 183 are in harnesses 184, thereby keeping holder 166 slightly taut. The unconstrained transverse extent of wingset 160, defined by the distance between a straight line coincident to it front most points, and a parallel straight line coincident to its rearmost point, is between 35 mm and 47 mm. In a preferred embodiment, the transverse extent is between 40 mm and 42 mm. At both lengthwise ends, wingset 160 is between 1.5 mm and 2.7 mm thick. Holder 166 is generally made of nonwoven fabric, such as neoprene. In a preferred embodiment wingsets 60, 64 and 160 are made of a polycarbonate/acrylonitrile Butadiene Styrene (PC/ABS) blend. In an alternative embodiment wingsets 60, 66 and 160 are made of a glass-filled polymer, such as a glass filled nylon.

3. Regarding Scope

The disclosed embodiments are illustrative, not restrictive. While specific configurations of the headlamp assembly design have been described it is understood that the present invention can be applied to a wide variety of headband uses. There are many alternative ways of implementing the invention.

What is claimed is:

1. A headband assembly, having a preferred orientation relative to a wearer's head, and comprising:

a) a closed form headband adapted to encircle a human head horizontally, thereby defining an inner surface and wherein at least one hard portion of said headband is hard relative to another portion of said headband;

b) a resiliently deformable wingset, supported by said headband on said inner surface, about said hard portion and including a central part and two wings, each extending laterally outwardly from said central part, each wing extending forward as it extends laterally from said central part and having a wing end; and c) a wingset holder, including a sheet of flexible material and engaged to both said wing ends, so that at least a portion of said sheet is suspended between said wing ends, thereby holding a wearer's head away from said hard portion when in use.

2. The headband assembly of claim 1, wherein said hard portion is a tightness adjustment subassembly.

3. The headband assembly of claim 1, wherein said wingset holder further includes further material extending from a first edge to a second edge, and wherein said further material is wrapped about said wingset and a portion of said headband and wherein said first edge is connected to said second edge, thereby retaining said wingset and said wingset holder to said headband.

4. The headband assembly of claim 1, wherein each said wing end has two prongs.

5. The headband assembly of claim 1, wherein said wingset and said headband have mating hook and loop material patches.

6. The headband assembly of claim 1, wherein said wingset is a rear wingset and wherein said headstrap assembly further includes a top strap assembly that is joined to said headstrap at two opposed locations, and is configured to extend over the top of a wearer's head, and includes a top hard portion, and wherein a top resiliently deformable wingset is located about said top hard portion and includes a central portion and a pair of wings projecting outwardly and downwardly from about said top tightness adjust element, to hold said top tightness adjust mechanism away from a wearer's head.

7. The headband assembly of claim 1, further including a medical headlamp, attached to said headband by a linkage.

8. The headband assembly of claim 1, has an unconstrained length as defined by a straight line extending from a tip of a first wing end to a tip of the other wing end, of between 140 mm and 150 mm.

9. The headband assembly of claim 1, having an unconstrained transverse dimension, defined by the distance between a straight line coincident to it front most points, and a parallel straight line coincident to its rearmost point of between 35 mm and 47 mm.

10. A comfort assembly, having a front adapted to receive a portion of a human head, and comprising:

a) a resiliently deformable wingset having a back and a front, and including a central part and two wings, each extending laterally outwardly from said central part, each wing extending forward as it extends laterally from said central part and having a wing end; and b) a wingset holder, including a sheet of flexible material and having pockets for receiving said wing ends, and wherein when said pockets are engaged to said wing ends at least a portion of said holder is suspended between said wing ends, and forming said front of said comfort assembly, and said holder further having a first edge having a first fastener and a second edge having a second fastener that can be fastened to said first fastener, when said first and second edges are wrapped about said wingset to said back of said wingset.

11. The comfort assembly of claim 10, wherein each said wing end includes two prongs.

12. The comfort assembly of claim 10, has an unconstrained length as defined by a straight line extending from a tip of a first wing end to a tip of the other wing end, of between 140 mm and 150 mm.

13. The comfort assembly of claim 8, having an unconstrained transverse dimension, defined by the distance between a straight line coincident to it front most points, and a parallel straight line coincident to its rearmost point of between 35 mm and 47 mm.

14. The comfort assembly of claim 8, wherein said wingset has a thickness at either lengthwise end of between 1.5 mm and 2.7 mm.

15. The comfort assembly of claim 8, wherein said sheet of flexible material is neoprene.

16. The comfort assembly of claim 8, wherein when said wingset is set into said wingset holder, said wingset is constrained to have a length that is constrained to a length that is between 5% and 15% less than its unconstrained length.

17. A method of augmenting a headband assembly, having a preferred orientation relative to a wearer's head, and which includes a closed form headband adapted to encircle a human head horizontally, thereby defining an inner surface and an outer side and at least one hard portion of said headband and being hard relative to another portion of said headband;

a) providing a comfort assembly, including:

i. a resiliently deformable wingset, including a central part and two wings, each extending laterally outwardly from said central part, each wing extending forward as it extends laterally from said central part and having a wing end; and ii. a wingset holder, engaged to both said wing ends, so that at least a portion of said holder is suspended between said wing ends, said holder further having a first edge having a first fastener and a second edge having a second fastener;

b) attaching said comfort assembly to said head band assembly at said hard portion by placing said wingset on said inner surface of said hard portion and wrapping said edges about to said outer side of said hard portion and fastening said first fastener to said second fastener.

18. The method of claim 17, wherein said hard portion is a tightness adjustment subassembly.

19. The method of claim 17, wherein each said wing end has two prongs.

20. The method of claim 17, wherein said wingset and said headband have mating hook and loop material patches and said mating hook and loop material patches are mated together prior to said first and second edges being wrapped to said outer side, thereby holding said comfort assembly to said head band hard portion, during said wrapping.

* * * * *